US007237660B2

(12) United States Patent
Wu

(10) Patent No.: US 7,237,660 B2
(45) Date of Patent: Jul. 3, 2007

(54) TRANSPORTING WHEEL STRUCTURE OF STORAGE OR LUGGAGE CONTAINER

(76) Inventor: Yi-Ming Wu, P.O. Box No. 6-57, Junghe, Taipei 235 (TW)

( * ) Notice: Subject to any disclaimer, the term of this patent is extended or adjusted under 35 U.S.C. 154(b) by 699 days.

(21) Appl. No.: 10/777,122

(22) Filed: Feb. 13, 2004

(65) Prior Publication Data

US 2005/0178630 A1 Aug. 18, 2005

(51) Int. Cl.
*A45C 13/30* (2006.01)
*A45C 13/00* (2006.01)

(52) U.S. Cl. ..... 190/18 A; 190/115; 280/655; 280/47.315

(58) Field of Classification Search ..... 190/18 A, 190/115; 280/47.315, 655
See application file for complete search history.

(56) References Cited

U.S. PATENT DOCUMENTS 4,254,850 A * 3/1981 Knowles ..... 190/18 A
5,533,231 A * 7/1996 Bai ..... 16/34
5,813,503 A * 9/1998 Chang ..... 190/18 A
6,289,554 B1 * 9/2001 Wang ..... 16/34
6,360,400 B1 * 3/2002 Chang ..... 16/113.1
6,367,602 B1 * 4/2002 Chang ..... 190/18 A
6,604,615 B2 * 8/2003 Wu ..... 190/18 A
6,612,411 B2 * 9/2003 Nykoluk et al. ..... 190/18 A
7,066,311 B2 * 6/2006 O'Shea ..... 190/18 A
2004/0004332 A1 * 1/2004 Tsai ..... 280/43.1

* cited by examiner

*Primary Examiner*—Tri M. Mai

(57) ABSTRACT

The invention discloses a transporting wheel structure of storage and luggage container. Particularly, the transporting wheel structure is applied at a lower portion of a container for facilitating movements of the container. Rollers of the transporting wheel structure can be pushed out for use or completely hidden when tucked in, and are prevented from staining clothes with dirt thereon when the container is lifted. The invention is characterized that, using relationships between inclined surfaces of triangular push members and vertical push members, the rollers can be pushed out for use or completely hidden when tucked in, thereby providing a pleasant-looking and functional structure.

1 Claim, 9 Drawing Sheets

TRANSPORTING WHEEL STRUCTURE OF STORAGE OR LUGGAGE CONTAINER

BACKGROUND OF THE INVENTION (a) Field of the Invention

The invention relates to a transporting wheel structure of storage or luggage container, and more particularly, to a transporting wheel structure disposed at a lower portion of a storage or luggage container so as to facilitate movements of the container. The transporting wheel structure of storage or luggage container comprises a plastic housing, triangular push members, vertical push members, steel wire rollers, steel wires, springs, inner casings, outer covers, lower casings, roller covers and rollers; and is capable or pushing the rollers outward for use or completely hiding and tucking in the rollers, so that clothes are not stained by dirt on the rollers when the container is lifted.

(b) Description of the Prior Art

When traveling abroad, one is obligated to carry toiletries and daily essentials apart from clothing, and a lady is even additionally loaded with cosmetics. To accommodate such numerous objects, a storage or luggage container is generally required for that not all objects can be placed into a hand-carried bag or a common handbag.

However, when a storage or luggage container is placed with so many objects, an overall weight is significantly increased. More specifically, the storage or luggage container becomes rather too awkward for a lady to carry. Thus, a storage or luggage container is provided with wheels at a lower portion thereof and a pull handle at an upper portion thereof, such that counteraction of the storage or luggage container and the ground is reduced using contact between the wheels below and the ground to easily move the container by pulling the pull handle. Furthermore, a storage or luggage container having tuck-in transporting wheels shown in FIG. 1 is also available. A principle of leverage is utilized, in that when a pull handle b is withdrawn and stretched, an interlocking mechanism is controlled and extended using a joined internal interlocking shaft a to project the transporting wheels from a surface of a container body c. It is to be noted that spaces for accommodating the transporting wheels a are connected with the surface of the container body c, and a general appearance is undesirably affected. In addition, the prior invention lacks protective effects over the transporting wheels a, and clothes are often stained by dirt on the wheels when the container is lifted. When the prior invention is not in use, the transporting wheels a are exposed at the surface of the container body c, and an appearance of the storage and luggage container is rather uncoordinated and unappealing. Above all, when the storage and luggage container is being stored, the transporting wheels a at a lower portion thereof are prone to slide to cause storage inconveniences. It is vital that the aforesaid shortcomings be advanced.

SUMMARY OF THE INVENTION

Therefore, to overcome the aforesaid shortcomings, the primary object of the invention is to provide a storage and luggage container capable of completely tuck in rollers thereof as well as offering a pleasant-looking and functional structure.

To achieve the abovementioned object, a transporting wheel structure of storage or luggage container according to the invention comprises a plastic housing, triangular push members, vertical push members, steel wire rollers, steel wires, springs, inner casings, outer covers, lower casings, roller covers and rollers. One side of each triangular push member is provided with clamping strips for corresponding and clamping sliding strips disposed at an interior of the plastic housing. After penetrating a steel wire through the steel wire roller, an inner side of each triangular push member is joined with an inserting member at a center portion of the plastic housing. Each triangular push member further has an upwardly inclined surface that is leaned against a downwardly inclined surface at one side of each vertical push member disposed in each inner casing. An interior of each inner casing has a shape identical to that of the vertical push members, and a size smaller than that of the vertical push members. Each inner casing has a central column at an upper center portion thereof. The central column is placed with a spring, and is then inserted into a round opening at an upper portion of each vertical push member. A lower portion of each vertical push member is penetrated through long openings respectively provided at the plastic housing and each lower casing, so as to support two side walls of each roller cover. The outer covers and the roller covers are first located at appropriate positions at the lower casings, followed by placing the springs at the outer covers and roller covers, and the rollers at center portions of the roller covers. The lower casings are finally stabilized in recesses at the lower portion of the plastic housing.

When the triangular push members at two sides are pulled by the steel wires to displace horizontally toward a center, the vertical push members are moved upward due to a relationship between the inclined surfaces. At this moment, the rollers are tucked in by the roller covers and the outer covers using restoring forces of the springs. When the steel wires are lax, the springs in the vertical push members make the vertical push members move downward so as to push the triangular push members at the two sides to move horizontally in outward directions. In addition, two side walls of the roller covers are butted by lower portions of the vertical push members to further push out the roller covers. Using the springs at the roller covers and the outer covers, roller covers and the outer covers are pushed open when the rollers are projected, and the rollers appear as completely hidden when observing an overall outer surface of the transporting wheel structure. Thus, the storage and luggage container according to the invention is a pleasant-looking and functional structure while being resistant to damages.

DETAILED DESCRIPTION OF THE PREFERRED EMBODIMENTS

To better understand the structures, devices and characteristics of the invention, detailed descriptions of a preferred embodiment shall be given with the accompanying drawings below.

Figure 1:
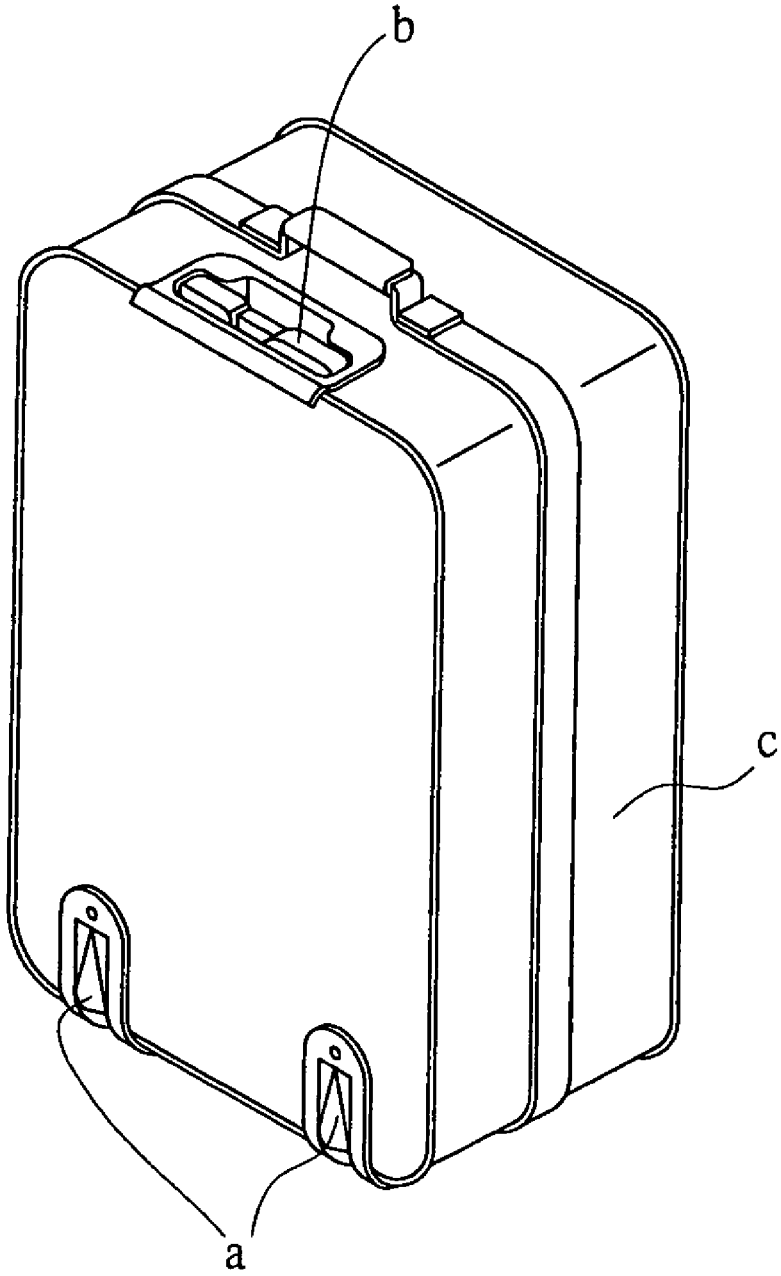
Fig.1 (prior art)
FIG. 1 shows a structural view illustrating tucked-in transporting wheels of a prior invention.
Figure 2:
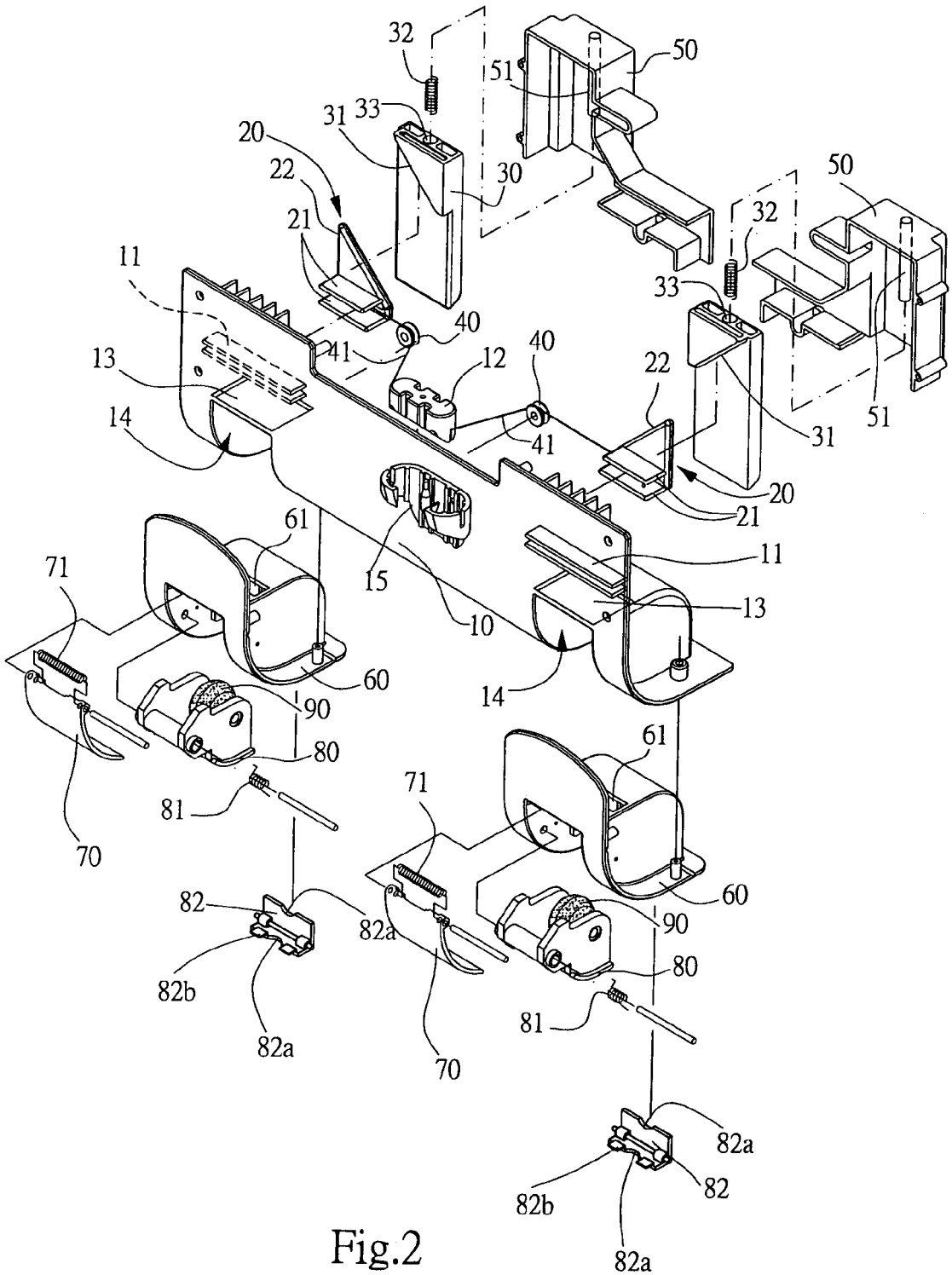
FIG. 2 shows an exploded elevational view according to the invention.
Figure 3:
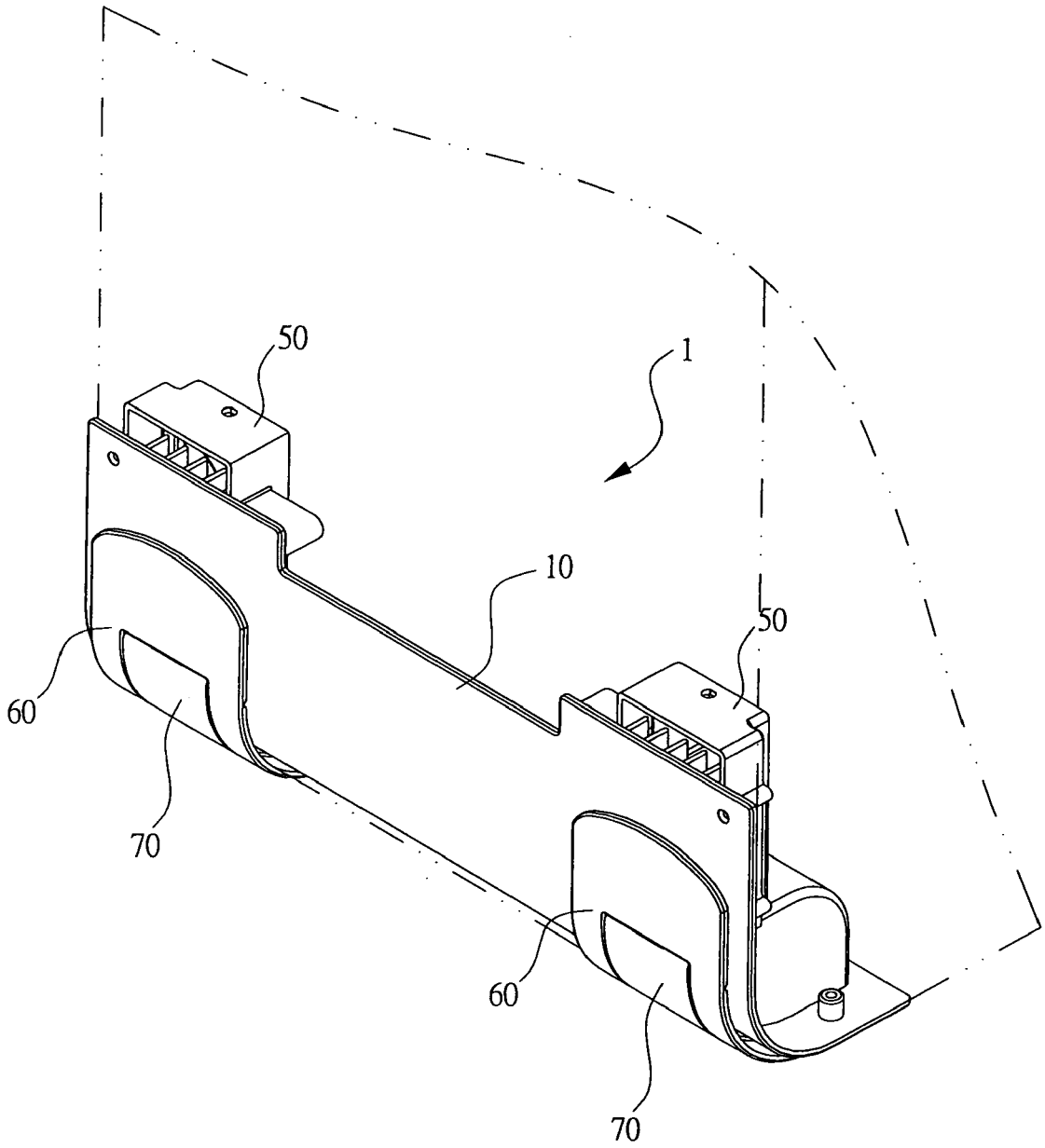
FIG. 3 shows an elevational view according to the invention in assembly.
Figure 4:
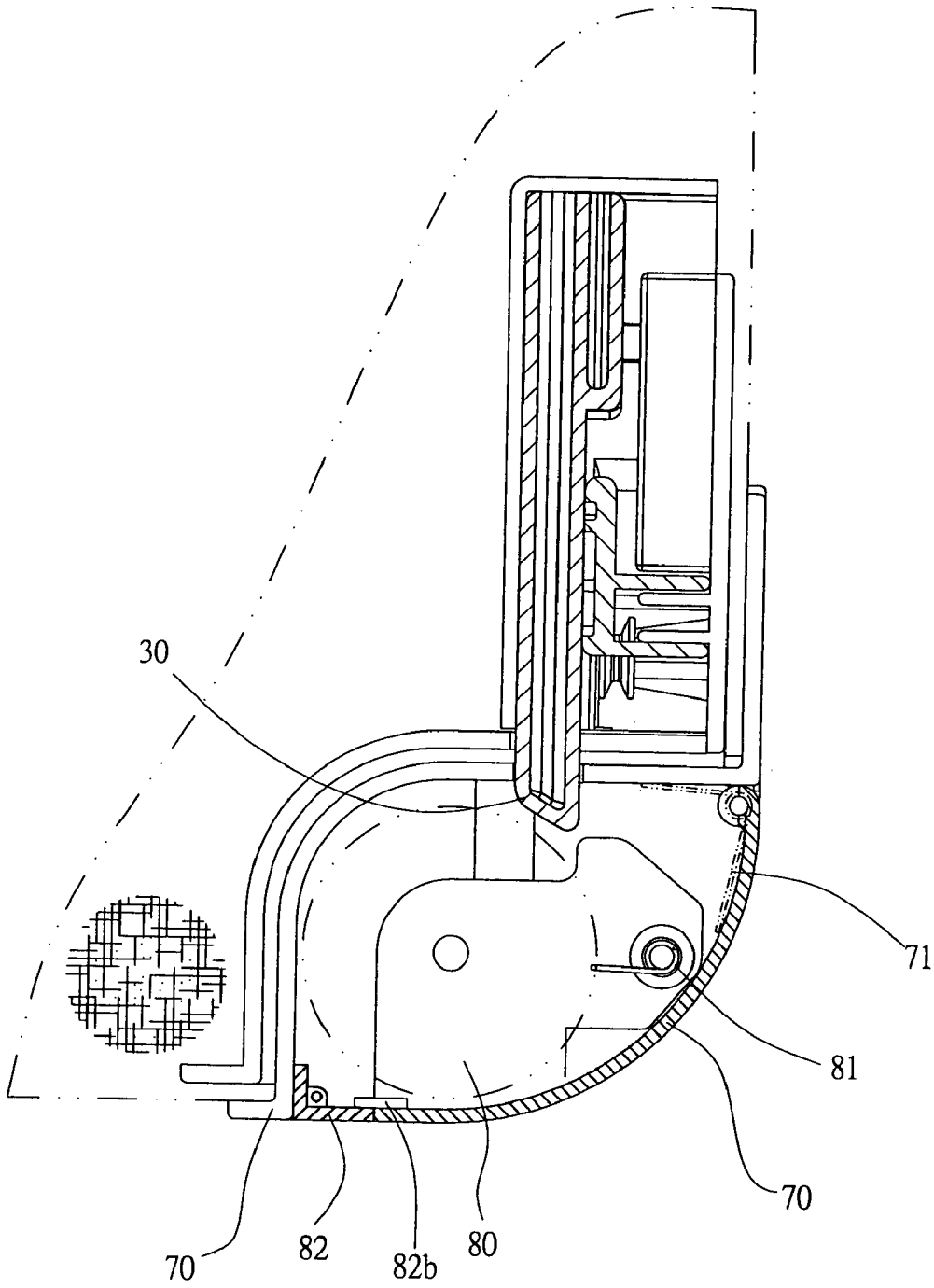
FIG. 4 shows a schematic view illustrating a tucked-in roller according to the invention.
Figure 5:
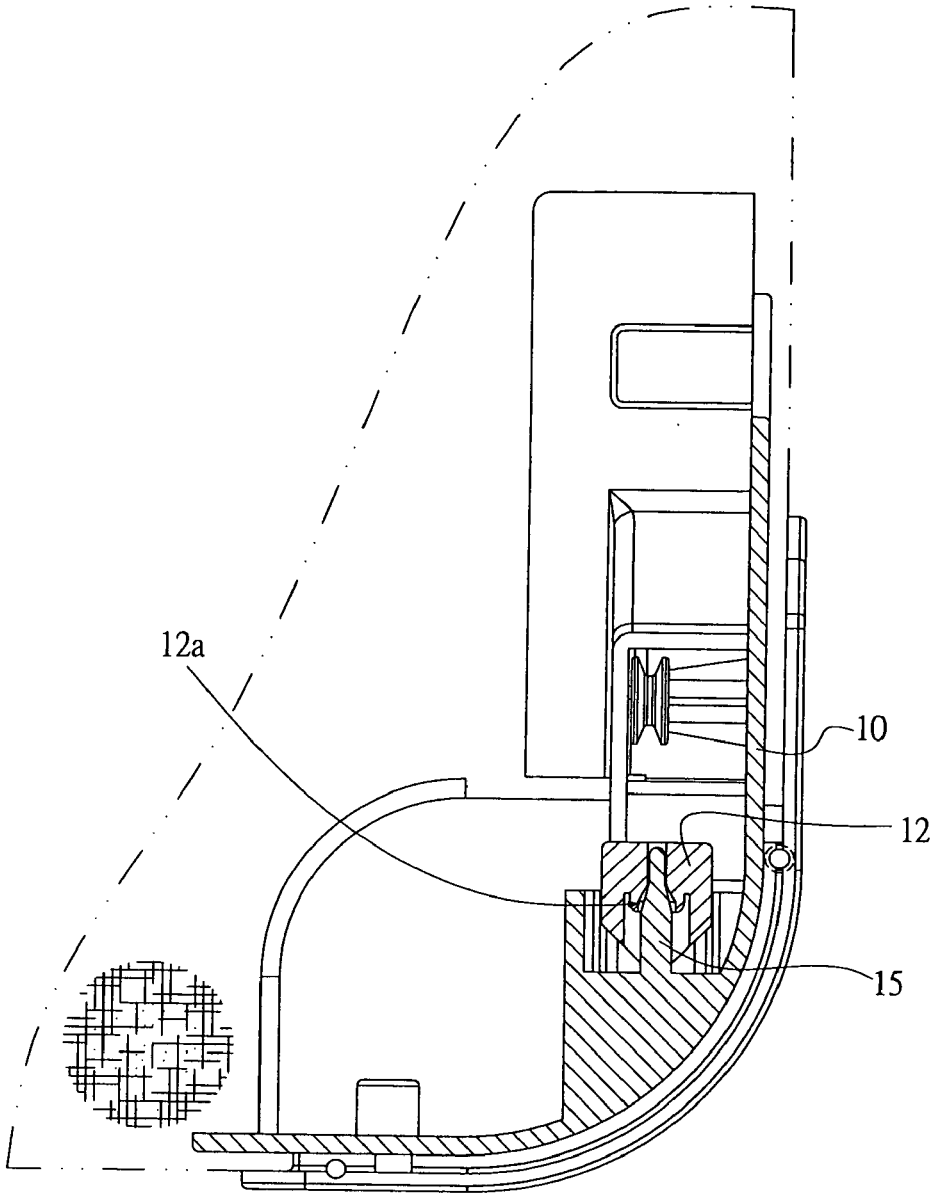
FIG. 5 shows a sectional view illustrating an inserting member disposed at the plastic housing according to the invention.

Referring to FIGS. 2 and 3, a transporting wheel structure 1 of storage and luggage container according to the invention comprises a plastic housing 10, triangular push members 20, vertical push members 30, steel wire rollers 40, inner casings 50, lower casings 60, outer covers 70, roller covers 80 and rollers 90. One side of each triangular push member 20 is provided with clamping strips 21 for corresponding and clamping sliding strips 11 disposed at an interior of the plastic housing 10. After penetrating a steel wire 41 through the steel wire roller 40, an inner side of each triangular push member 20 becomes joined with an inserting member 12 at a center portion of the plastic housing 10. Using up-and-down movements of the inserting member 12, the triangular push members 20 are driven by the steel wires 41 to perform horizontal sliding movements. Each triangular push member 20 further has an upwardly inclined surface 22 that is leaned against a downwardly inclined surface 31 at one side of each vertical push member 30 disposed in each inner casing 50. An interior of each inner casing 50 has a shape identical to that of the vertical push members 30, and a size smaller than that of the vertical push members 30, with the triangular push members 20, the vertical push members 30, the steel wire rollers 40 and steel wires 41 contained therein. Each inner casing 50 has a central column 51 at an upper center portion thereof. The central column 51 is accommodated around a spring 32, and is inserted into a round opening 33 at an upper portion of each vertical push member 30. A lower portion of each vertical push member 30 is penetrated through long openings 13 and 61 respectively provided at the plastic housing 10 and each lower casing, so as to support two side walls of each roller cover 80. The outer covers 70 and the roller covers 80 are first located at appropriate positions at the lower casings 80, followed by placing springs 71 and 81 at the outer covers 70 and roller covers 80, and the rollers 90 at center portions of the roller covers 60. The lower casings 60 are stabilized in recesses 14 at the lower portion of the plastic housing 10. To install the roller covers 80 to the lower casings 60, L-shaped plates 82 are provided at a rear portion of the roller covers 82. A lower panel section and a center portion of a vertical section of each L-shaped plate 82 are respectively provided with a notch 82*a* for corresponding with a shape of each roller 90. Each notch 82*a* is disposed with two protrusions 82*b* at two sides thereof for fastening an interior of each roller cover 80. Referring to FIG. 4 showing a schematic view illustrating a tucked-in roller according to the invention, when the vertical push member 30 is moved upward, the roller cover 80 and the outer cover 70 are drawn inward owing to restoring forces of the springs 71 and 81. At this point, an outer surface of the roller cover 80 is leveled with an outer surface of the lower casing 60, and an inner side of the roller cover 80 is fastened by the protrusions 82*b* of the L-shaped plate 82 to develop into a stabilized status. Referring to FIG. 5 showing an inserting member 12 disposed at the plastic housing 10 according to the invention, the inserting member 12 has a funnel-shaped opening 12*a* and is thus accommodated around an insertion pole 15 of the plastic housing 10. Using coordinated positions of the insertion pole 15 and the funnel-shaped opening 12*a* in conjunction with guiding effects of the funnel shape, the inserting member 12 is capable of linear up-and-down movements around the insertion pole 15 without becoming disengaged.

Figure 6A:
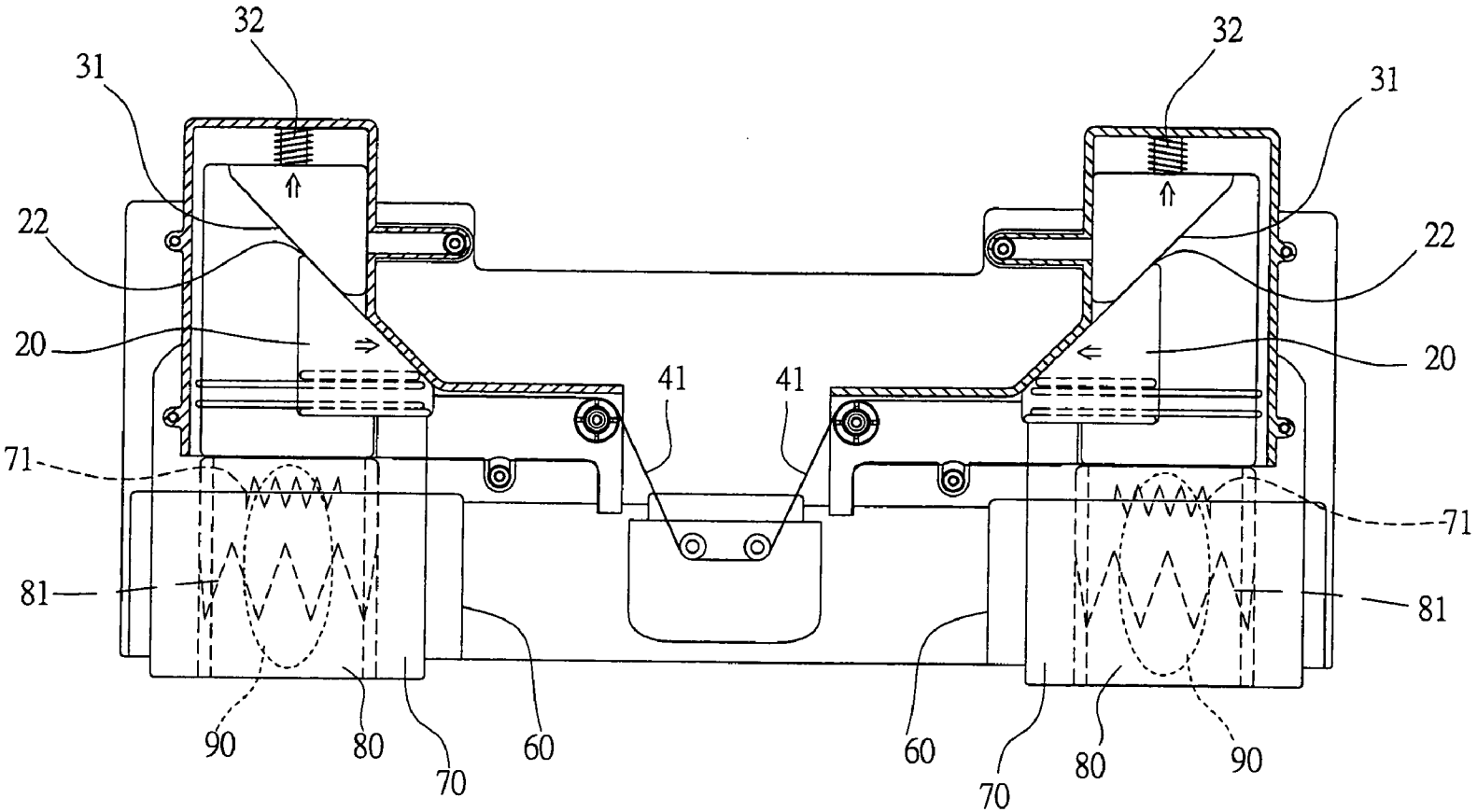
FIG. 6A shows a schematic view illustrating motions of an embodiment according to the invention.
Figure 6B:
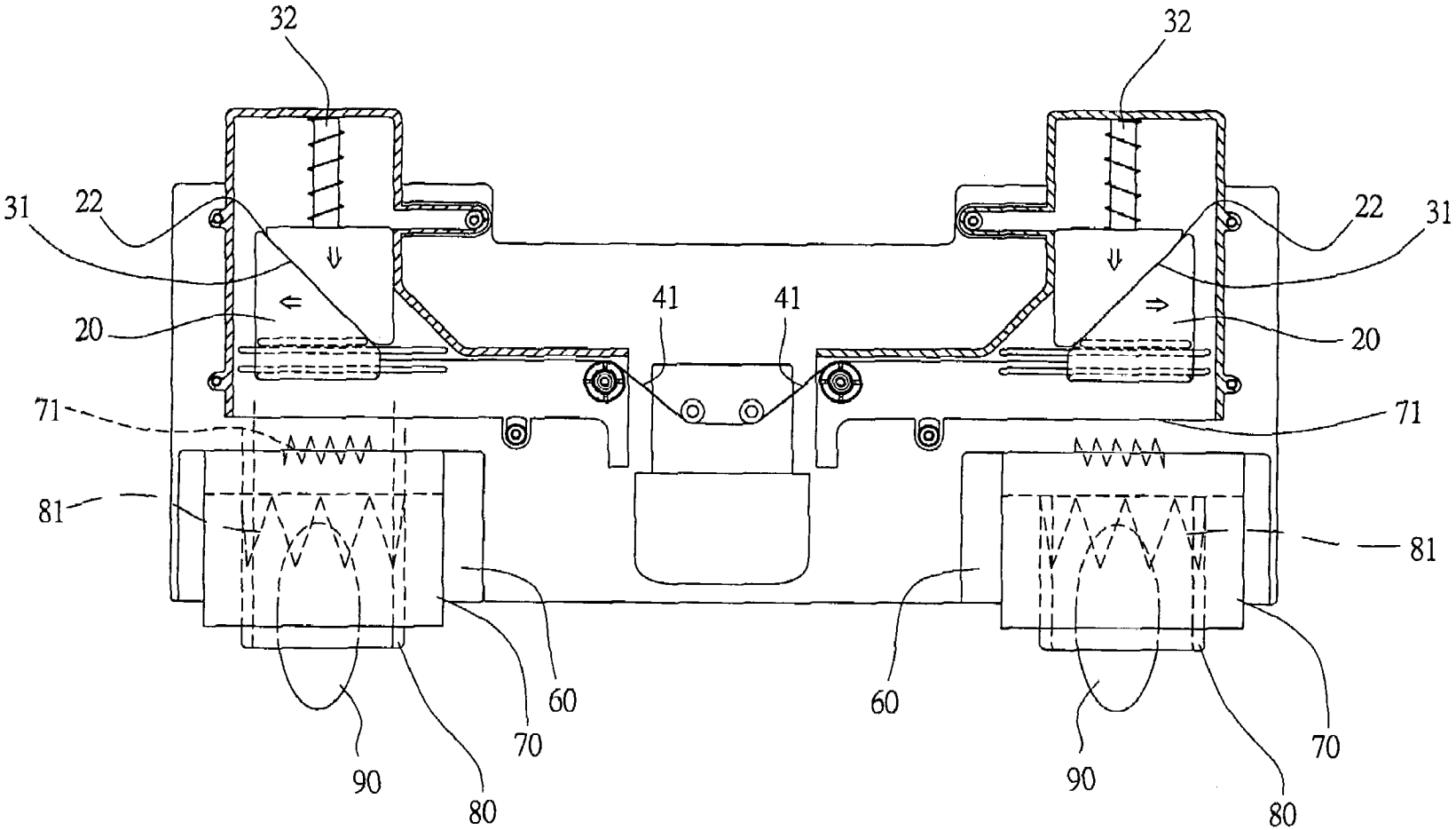
FIG. 6B shows a schematic view illustrating motions of an embodiment according to the invention.
Figure 7A:
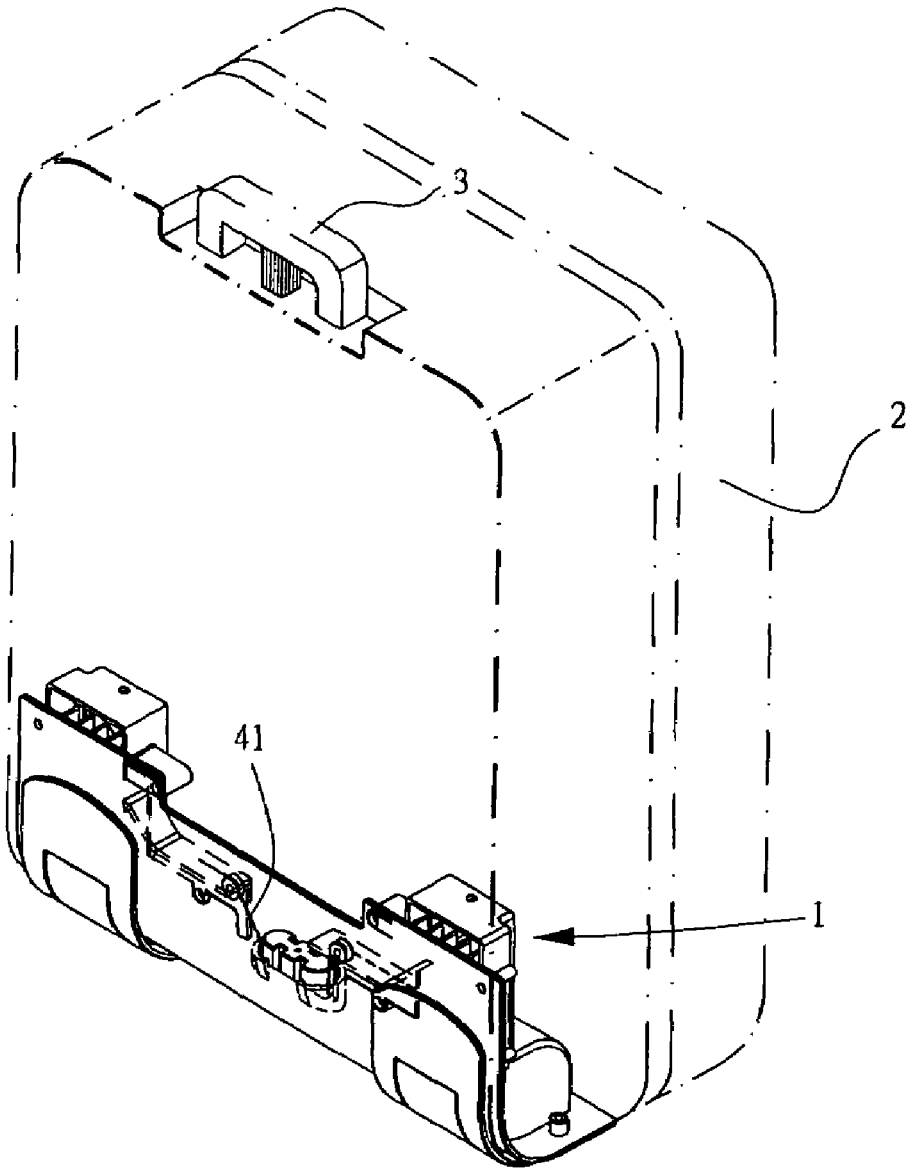
FIG. 7A shows an elevational view of an embodiment according to the invention.
Figure 7B:
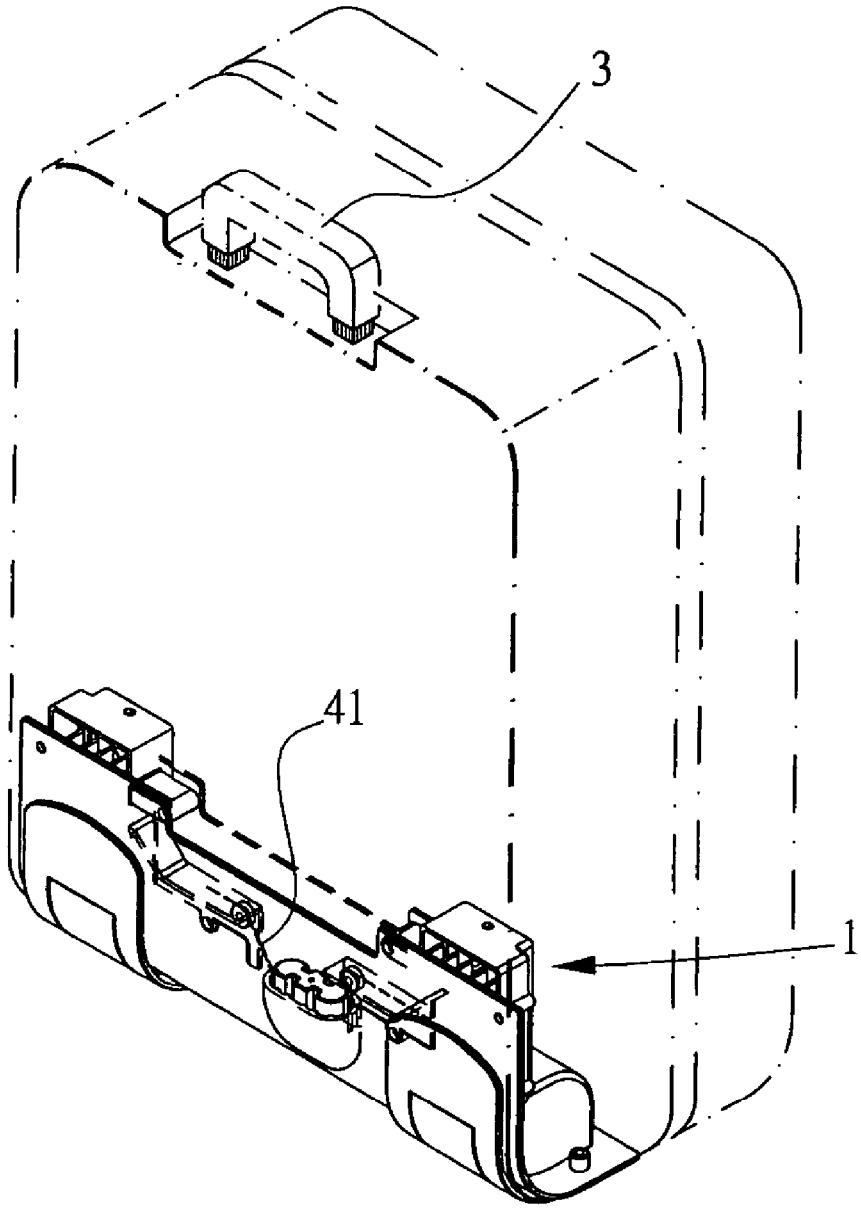
FIG. 7B shows an elevational view of an embodiment according to the invention.

Referring to FIGS. 6A and 6B, when the triangular push members 20 at two sides are pulled by the steel wires 41 to displace horizontal toward a center, the vertical push members 30 are moved upward due to a relationship between the inclined surfaces 22 and 31. At this moment, the rollers 90 are tucked in by the roller covers 80 and the outer covers 70 using restoring forces of the springs 81 and 71, and then become totally hidden when observing an overall outer surface. When the steel wires 41 are lax, the springs 32 in the vertical push members 30 make the vertical push members 30 move downward so as to push the triangular push members 20 at the two sides to move horizontally in outward directions. In addition, two side walls of the roller covers 70 are butted by lower portions of the vertical push members 30 to further push out the roller covers 80. Using the springs 81 and 71 at the roller covers 80 and the outer covers 70, the rollers 90 are projected outward to develop an in-use status. Referring to FIGS. 7A and 7B showing two embodiments of the invention being applied, the transporting wheel structure 1 is installed at a lower lateral side of a container body 2, and the internal steel wires 41 are pulled by one or two pull handles 3, thereby operating the entire transporting wheel structure 1.

Conclusive from the above, using relationships between steel wires, push members and springs, the storage and luggage container according to the invention accomplishes effects of completely hiding or providing handiness for usage of the transporting wheel structure. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A transporting wheel structure of storage or luggage container includes a plastic housing, triangular push members, vertical push members, steel wire rollers, steel wires, springs, inner casings, outer covers, lower casings, roller covers and rollers; and being characterized that, one side of each triangular push member is provided with clamping strips for corresponding and clamping sliding strips disposed at an interior of the plastic housing; after penetrating a steel wire through the steel wire roller, an inner side of each triangular push member is joined with an inserting member at a center portion of the plastic housing; said inserting member has a funnel-like opening at an interior thereof, such that an insertion pole of the plastic housing is accommodated in the funnel-like opening to further contain the triangular push members; said vertical push members, steel wire rollers and steel wires being in the inner casings; each triangular push member further has an upwardly inclined surface that is leaned against a downwardly inclined surface at one side of each vertical push member disposed in each inner casing; each inner casing has a central column at an upper center portion thereof, with the central column being accommodated around a spring, and inserted into a round opening at an upper portion of each vertical push member, such that upwardly inclined surfaces of the triangular push members are leaned against downwardly inclined surfaces of the vertical push members; the outer covers and the roller covers are first located at appropriate positions at the lower casings; L-shaped plates are provided at a rear portion of the roller covers; a lower panel section and a center portion of a vertical section of each L-shaped plate are respectively provided with a notch for corresponding with a shape of each roller; each notch is disposed with two protrusions at two sides thereof for fastening an interior of each roller cover; the springs are respectively placed at the outer covers and the roller covers, and the lower casings are stabilized at recesses of the plastic housing; lower portions of the vertical push members are penetrated through the long openings of the plastic housing and the lower casings to support two side walls of each roller cover; and according to the aforesaid structure, the rollers are completely hidden in the recesses when tucked in.

* * * * *